US012714264B2

(12) United States Patent
Doubet et al.

(10) Patent No.: US 12,714,264 B2
(45) **Date of Patent: *Aug. 25, 2026**

(54) DISPENSER MOUNTING COLLAR

(71) Applicant: Bradley Fixtures, LLC, Menomonee Falls, WI (US)

(72) Inventors: Eric William Doubet, Oak Creek, WI (US); Mark A. Meyer, Menomonee Falls, WI (US); Mark A. Thielke, Menomonee Falls, WI (US); Laura Beth Stang, Mukwonago, WI (US); Michelle L. Rundberg, Jackson, WI (US)

(73) Assignee: Bradley Fixtures, LLC, Menomonee Falls, WI (US)

( * ) Notice: Subject to any disclaimer, the term of this patent is extended or adjusted under 35 U.S.C. 154(b) by 253 days.

This patent is subject to a terminal disclaimer.

(21) Appl. No.: 18/244,581

(22) Filed: Sep. 11, 2023

(65) Prior Publication Data

US 2023/0414045 A1 Dec. 28, 2023

Related U.S. Application Data

(63) Continuation-in-part of application No. 18/238,881, filed on Aug. 28, 2023, now Pat. No. 12,507,834,
(Continued)

(51) Int. Cl.
*A47K 5/12* (2006.01)

(52) U.S. Cl.
CPC ..... *A47K 5/1217* (2013.01)

(58) Field of Classification Search
CPC ..... A47K 5/1217
(Continued)

(56) References Cited

U.S. PATENT DOCUMENTS 5,820,168 A * 10/1998 De Giacomoni ..... F16L 3/10 285/330
6,467,651 B1 * 10/2002 Muderlak ..... B05B 12/02 222/63

(Continued)

FOREIGN PATENT DOCUMENTS

| | | | |
|---|---|---|---|
| CN | 111779081 | A | 10/2020 |
| CN | 215802008 | U | 2/2022 |
| WO | 2013158637 | A2 | 10/2013 |

OTHER PUBLICATIONS

International Search Report, PCT/US2023/032404, Jan. 3, 2024.

*Primary Examiner* — Paul R Durand
*Assistant Examiner* — Michael J. Melaragno
(74) *Attorney, Agent, or Firm* — Boyle Fredrickson S.C.

(57) ABSTRACT

A soap dispenser mounting collar includes a lower surface in contact with a countertop and an upper surface in contact with a soap dispenser mounting shank. The mounting shank extends through the mounting collar. The mounting collar further includes an outer surface aligned with a first outer surface of the mounting shank directly above the outer surface of the mounting collar, and an inner surface in contact with a second outer surface of the mounting shank extending through the soap dispenser mounting collar. The inner surface of the mounting collar includes a plurality of contour features configured to interfit with a plurality of corresponding contour features of the mounting shank in order to maintain alignment of the mounting collar and the mounting shank.

20 Claims, 12 Drawing Sheets

Related U.S. Application Data which is a continuation of application No. 16/295,953, filed on Mar. 7, 2019, now abandoned.

(60) Provisional application No. 63/405,170, filed on Sep. 9, 2022.

(58) Field of Classification Search
USPC ..... 222/39
See application file for complete search history.

(56) References Cited

U.S. PATENT DOCUMENTS 7,269,864 B2 * 9/2007 Brown ..... E03C 1/0401 4/678
7,364,053 B2 * 4/2008 Ophardt ..... A47K 5/16 222/145.5
7,527,174 B2 * 5/2009 Meehan ..... A47K 5/1205 141/332
2002/0185500 A1 * 12/2002 Muderlak ..... A61L 9/12 222/1
2006/0152917 A1 * 7/2006 Stuhlmacher, II .... F21V 33/004 362/109
2006/0180221 A1 * 8/2006 Ko ..... E03C 1/0401 137/801
2007/0187427 A1 * 8/2007 Shaw ..... A47K 5/1202 222/173
2010/0005655 A1 * 1/2010 Nguyen ..... B25B 33/00 29/280
2011/0174838 A1 * 7/2011 Schroeder ..... F16L 37/142 285/305
2011/0290949 A1 * 12/2011 Trouve ..... F16C 1/265 248/65
2013/0075420 A1 * 3/2013 Tramontina ..... A47K 5/1205 222/1
2013/0270300 A1 * 10/2013 Ciavarella ..... A47K 5/1205 222/173
2014/0231450 A1 * 8/2014 Rosko ..... A47K 5/1211 222/52
2014/0263421 A1 * 9/2014 Urban ..... A47K 5/1211 222/173
2014/0263892 A1 * 9/2014 Metcalfe ..... F16M 13/02 248/205.3
2015/0230668 A1 * 8/2015 Shakkour ..... A47K 5/1215 222/153.09
2017/0051479 A1 2/2017 Ltd.
2020/0281417 A1 9/2020 Corporation

* cited by examiner

DISPENSER MOUNTING COLLAR

CROSS-REFERENCE TO RELATED APPLICATIONS

The present application claims priority to U.S. Provisional Patent Application No. 63/405,170, filed on Sep. 9, 2022. The entire contents of which are hereby expressly incorporated by reference into the present application.

The present application further is a continuation-in-part and claims priority to U.S. Non-Provisional patent application Ser. No. 18/238,881, filed on Aug. 28, 2023, which is a continuation of U.S. Non-Provisional patent application Ser. No. 16/295,953, filed on Mar. 7, 2019. The entire contents of both are hereby expressly incorporated by reference into the present application.

BACKGROUND OF THE INVENTION

1. Field of the Invention

The present invention relates in general to a mounting collar for a dispenser system. More particularly, the present invention relates to a mounting collar for a dispenser system that includes contouring to prevent mismatching of the mounting collar and the dispenser of the dispenser system.

2. Discussion of the Related Art

Many washrooms include wash basins that each have their own separate water faucets and soap dispensers. The water faucet and soap dispenser extend out over the wash basin to allow a user to utilize both the water faucet and soap dispenser without removing his or her hands from the wash basin and getting excess water and soap on the countertop. Each soap dispenser is fluidically connected to and dispenses soap from a soap container. As the soap dispenser is used over time, the soap container needs to be refilled by a maintenance worker. If the soap container is not refilled, the soap dispenser will no longer dispense soap once the soap container is empty. In instances where the soap dispenser can be removed to access a refill port, it is noted that removal and reinstallation of the soap dispenser can cause rotation of elements from a preferable alignment with each other, for instance misalignment of a mounting collar and a mounting shank.

As such, there is a need in the art for a soap dispenser system that includes a mounting collar and a mounting shank that are configured to interfit with each other and includes features that maintain alignment of the mounting collar and the mounting shank during physical manipulation of the dispenser itself.

SUMMARY AND OBJECTS OF THE INVENTION

The present invention is directed to a mounting collar for a dispenser system. More particularly, the present invention relates to a mounting collar for a dispenser system including contouring that prevents mismatching of the mounting collar and the dispenser of the dispenser system during manipulation thereof.

According to an embodiment of the invention, a soap dispenser mounting collar includes a lower surface in contact with a countertop and an upper surface in contact with a soap dispenser mounting shank. The mounting shank extends through the mounting collar. The mounting collar further includes an outer surface aligned with a first outer surface of the mounting shank directly above the outer surface of the mounting collar, and an inner surface in contact with a second outer surface of the mounting shank extending through the soap dispenser mounting collar. The inner surface of the mounting collar includes a plurality of contour features configured to interfit with a plurality of contour features of the mounting shank in order to maintain alignment of the mounting collar and the mounting shank.

In accordance with another aspect of the invention, the mounting collar may include an indent formed in the inner surface of the mounting collar. The indent is configured to space apart the inner surface of the mounting collar from the second outer surface of the mounting shank to form an opening. In addition, the second outer surface of the mounting shank may also include an indent aligned with the indent of the inner surface of the mounting collar.

In accordance with yet another aspect of the invention, the plurality of contour features of the mounting collar may be disposed on a single side of the mounting collar. Similarly, the plurality of contour features of the mounting shank may be disposed on a single side of the mounting shank. Alternatively, the plurality of contour features of the mounting collar may be disposed on a plurality of sides of the mounting collar, while the plurality of contour features of the mounting shank may be disposed on a plurality of sides of the mounting shank. It is also contemplated that the plurality of contour features of the mounting collar may be disposed on opposite sides of the mounting collar, while the plurality of contour features of the mounting shank may be disposed on opposite sides of the mounting shank.

In accordance with another aspect of the invention, the plurality of contour features of the mounting collar may be any combination of extensions or recesses formed on the inner surface of the mounting collar. Similarly, the plurality of contour features of the mounting shank may be any combination of extensions or recesses formed on the inner surface of the mounting shank.

These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
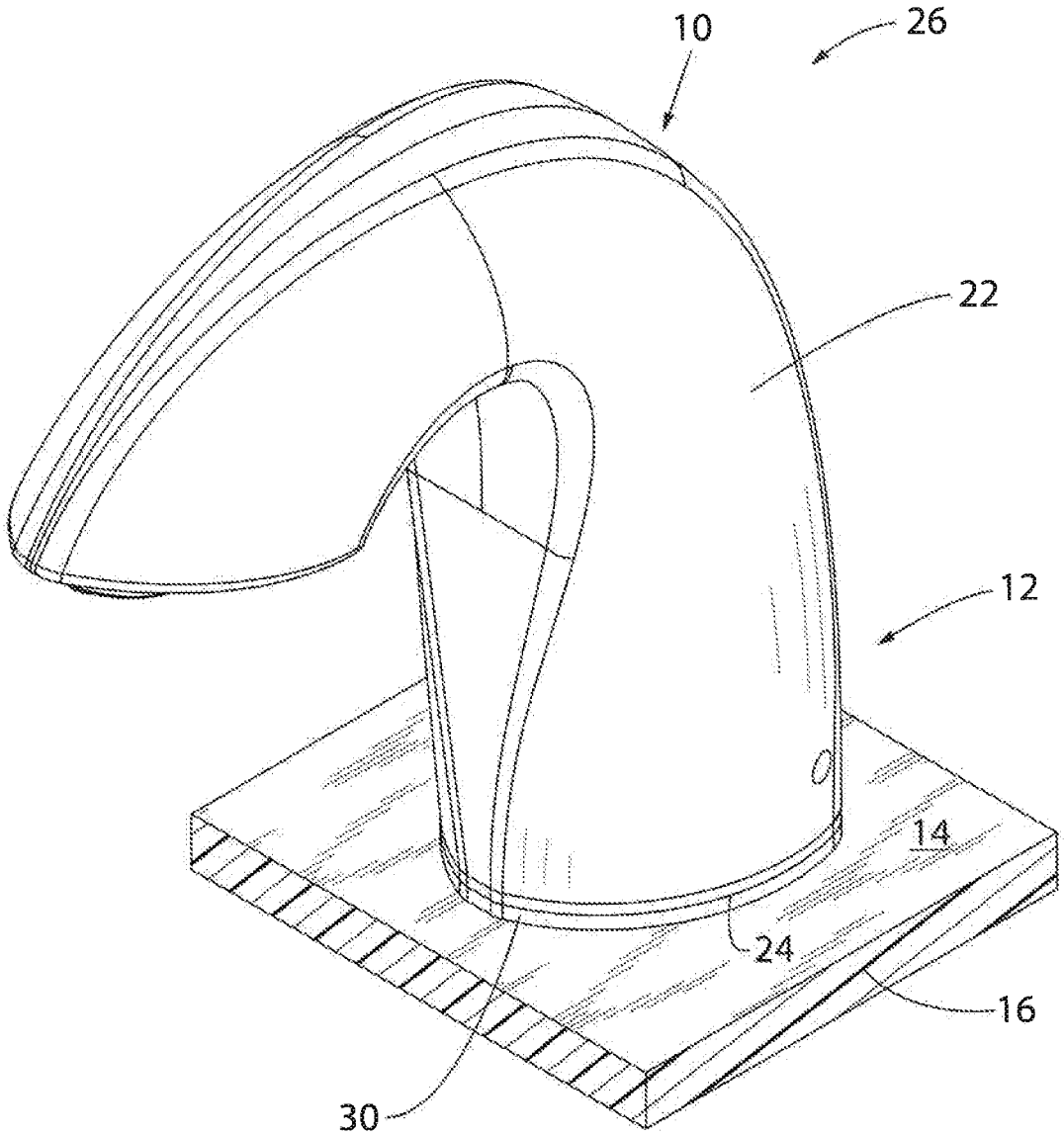
FIG. 1 is a perspective view of the dispenser system in a closed orientation.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected, attached, or terms similar thereto are often used. They are not limited to direct connection but include connection through other elements where such connection is recognized as being equivalent by those skilled in the art.

DESCRIPTION OF PREFERRED EMBODIMENTS

The present invention and the various features and advantageous details thereof are explained more fully with reference to the non-limiting embodiments described in detail in the following description.

Throughout this description, various terms denoting direction, such as left and right, front and rear, up and down, top and bottom, and the like may be used. The directions are not intended to be limiting but are used to describe relationships of elements with respect to each other in the accompanying drawings. Unless mutually exclusive, it is contemplated that the elements may be reversed, for example, by turning a component around or upside down without deviating from the scope of the present invention.

Figure 2:
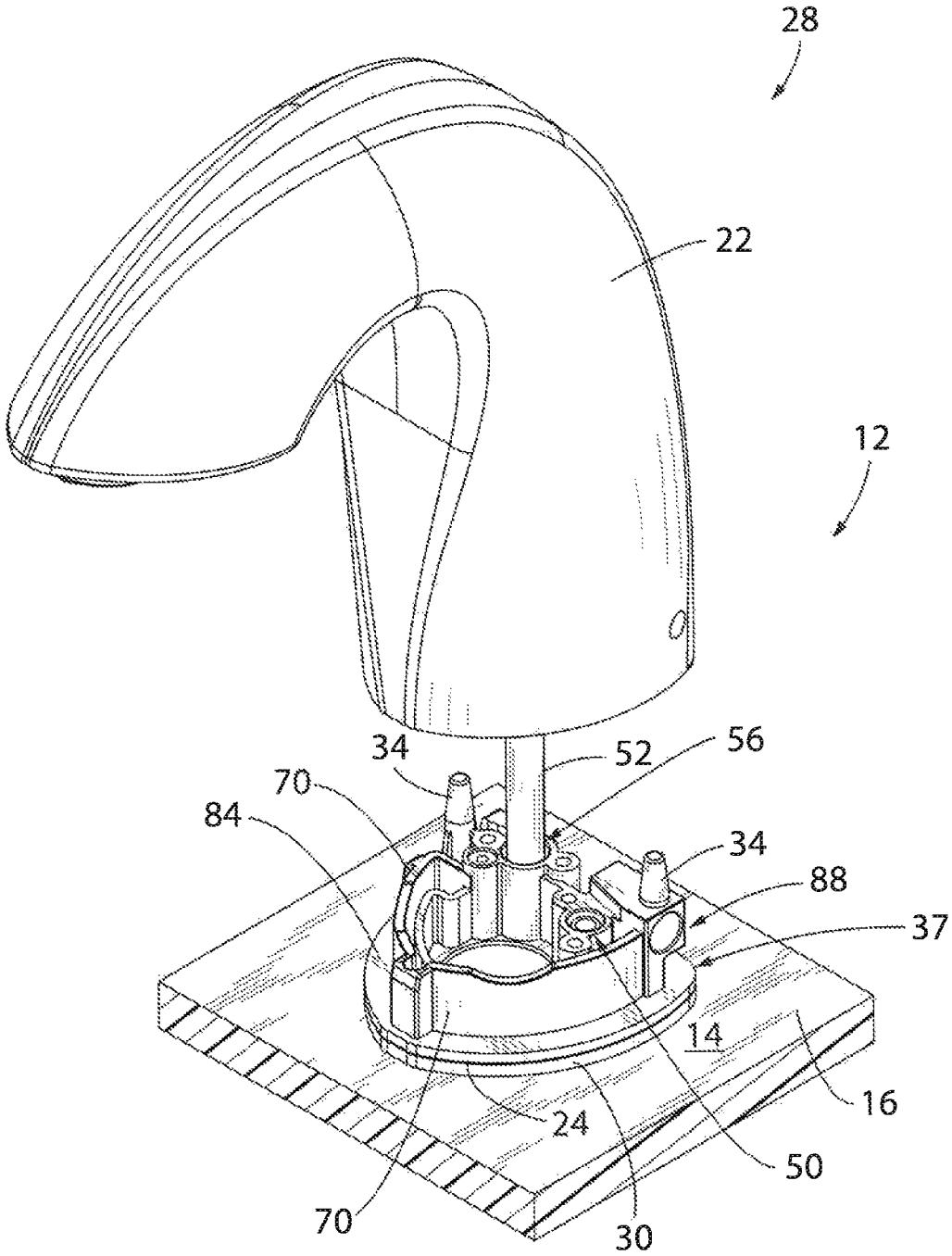
FIG. 2 is a perspective view of the dispenser system in an open orientation.

Referring first to FIGS. 1 and 2, a perspective view of a soap dispensing system 10 including a soap dispensing fixture 12 in a closed orientation 26 and an open orientation 28. The fixture 12 is mounted to an upper surface 14 of a countertop 16. The soap dispensing system 10 also includes a soap container (not shown), a pump (not shown), and a control box (not shown) disposed below the countertop 16. As shown, the fixture 12 include a main body 22 removably coupled to a mounting shank 24. The mounting shank 24 is mounted to and extends above, below, and through the countertop 16.

Figure 3:
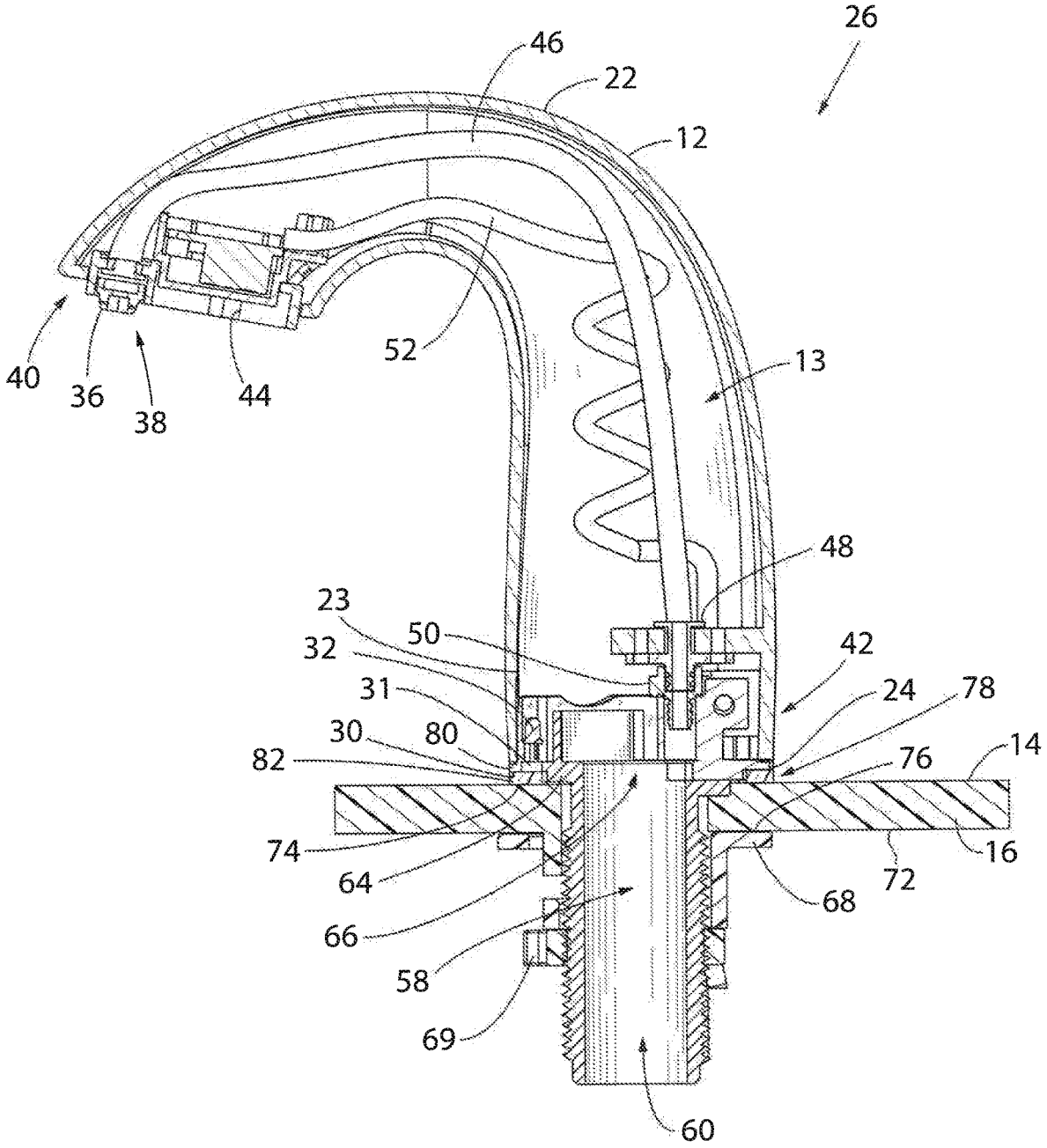
FIG. 3 is an enlarged side view of a collar of the dispenser system of FIG. 1.

FIG. 3 is a cross-sectional view of the soap dispensing system 10 to further illustrate the elements disposed within a cavity 13 within the fixture 12. The fixture 12 includes a dispensing element 36 disposed at an outlet 38 thereof. The outlet 38 of the fixture 12 is located at a first end 40 of the main body 22, while a second end 42 of the main body 22 is in contact with the mounting shank 24. In the representative embodiment of the invention, the main body 22 of the fixture extends from the first end 40 to the second end 42 in an arc shape. However, in other embodiments of the invention, the fixture main body 22 may extend from the first end 40 to the second end 42 in any shape. Further, a hand sensor 44 may be disposed within the outlet 38 of the fixture main body 22 and adjacent to the dispensing element 36.

A fluid supply line 46 extends from the dispensing element 36 at the first end 40 of the fixture 12 to the first fluid connector 48 at the second end 42 of the fixture 12. The mounting shank 24 of the fixture 12 includes the second fluid connector 50 extending upward therefrom. As described above, the first and second fluid connectors 48, 50 are coupled in the closed orientation 26 of FIG. 1 and decoupled in the open orientation 28 of FIG. 2.

Wiring 52 may be tethered from the control box underneath the countertop 16 to the hand sensor 44 and dispensing element 36 at the first end 40 of the fixture 12. It is contemplated that the mounting shank 24 of the fixture 12 may include a wire guide 56 formed therein and having an opening therethrough to allow the wiring 52 to extend through the mounting shank 24 and into the cavity 13 of the fixture main body 22. As shown in FIG. 2, the wiring 52 may be coiled in order to allow the wiring 52 to move as necessary and without exerting any forces on the on the control box, the hand sensor 44, or the dispensing element 36 when the main body 22 of the fixture 12 is displaced from the mounting shank 24 of the fixture 12. Additionally, the coiling of the wiring 52 assists in fitting the wiring 52 within the main body 22 without unnecessary duress by the user or maintenance workers.

In an alternative embodiment of the invention, the wiring 52 may be configured to detachably connectable, similar to the fluid supply line 46 described above. In such an embodiment, the wiring 52 may extend from the first end 40 of the fixture 12 to a first wire connector at the second end 42 of the fixture 12. The mounting shank 24 of the fixture 12 may then include a second wire connector disposed at wire guide 56 and extending upward from the fixture mounting shank 24. In turn, the first and second wire connectors may be detachably connected to each other so that they can be detached when the main body 22 is displaced from the mounting shank 24.

As shown in FIG. 3, the mounting shank 24 of the fixture 12 includes a refill port 58 extending from above the countertop 16 to below the countertop 16. A lower portion 60 of the refill port 58 may be threaded to engage with a refill hose (not shown) extending between the refill port 58 and the soap container. An upper mount 64 extends laterally from an upper end 66 of the refill port 58 to engage the upper surface 14 of the countertop 16. Meanwhile, a lower mount 68 slidably engages the refill port 58. In the representative embodiment of the invention, the lower mount 68 surrounds the lower portion 60 of the refill port 58 and can rotate until it contacts a lower surface 72 of the countertop 16 and engages the lower surface 72 of the countertop 16. In the representative embodiment of the invention, a lower surface 74 of the upper mount 64 is spaced apart from an upper surface 76 of the lower mount 68 by a distance equal to or approximately equal to the thickness of the countertop 16. As a result, the countertop 16 is sandwiched between the upper and lower mounts 64, 68. In turn, a mounting nut 69 is further secured to the lower portion 60 of the refill port 58. As shown in FIG. 2, the mounting nut 69 and the lower portion 60 of the refill port 58 are both configured to threadably engage with each other to secure the mounting nut 69 to the refill port 58. As such, the mounting nut 69 assists in securing the lower mount 68 in place.

The dispensing system 10 further includes a mounting collar 30 disposed adjacent the countertop 16 and between a portion of the mounting shank 24 and the countertop 16. In turn, an illumination device 32, such as, but not limited to an LED, may be disposed within the mounting shank 24 at a location adjacent the collar 30 in order to illuminate the collar 30 and provide a visual indication of the status or operation of the soap dispensing system 10. As such, the collar 30 and the illumination device 32 combine to create an indication system 31. While the representative embodiment of the invention depicts the illumination device 32 as being located above the collar 30 and at the front of the fixture mount 24, it is contemplated that other embodiments of the invention may locate the illumination device 32 above, below, or in-line with the collar 30 and at any location around the mounting shank 24 including, but not limited to, the front, sides, and rear of the fixture mount 24. The collar 30 is preferably a translucent material that allows the illumination device 32 to illuminate the collar 30. For example, the collar 30 may be a translucent silicone. The operation of the illumination device 32 will be further described below. Additionally, the LED 32 may be electrically coupled to the control box 21 by way of wiring 51.

It is contemplated that the LED 32 of the collar may illuminate differently for different statuses and operations of the system 10. For example, the LED 32 may illuminate by flashing green, red, or any other color when the system 10 is turned on. The LED 32 may flash any number of times or for any predetermined period of time. In one particular embodiment, the LED may flash green three (3) times. In yet other embodiments of the invention, the LED 32 may illuminate steadily for any number of seconds.

In another example, the LED 32 may illuminate to indicate a low soap level in the soap container. For example, the low soap level sensor may be triggered when the soap level of the container is at or below a designated low soap level, such as 20%, 25%, or the like of the volume of the soap container. In other embodiments of the invention, the designated low soap level may be above or below 20% of the volume of the soap container. The LED 32 may illuminate by flashing red or any other color until the soap has been filled past the designated low soap level. The LED 32 may cycle between on and off for any number of seconds. In one example, the LED 32 may flash by cycling between on for 0.2 seconds and off for 2 seconds. However, this is not a limiting example. In other embodiments of the invention, the LED 32 may illuminate steadily for any number of seconds. It should also be noted that the system 10 is still able to dispense soap while the LED 32 indicates a low soap level.

The LED 32 may also illuminate to indicate a high soap level in the soap container. The high soap level sensor may be triggered when the soap level of the container is at or above a designated high soap level, such as, but not limited to, 75%, 80%, or the like of the volume of the soap container. In other embodiments of the invention, the designated high soap level may be above or below 80% of the volume of the soap container. The LED 32 may illuminate one or more of any color steadily for any number of seconds. For example, the LED 32 may illuminate red for 2.5 seconds. In other embodiments of the invention, the LED 32 may illuminate another color, such as, but not limited to, green, for any amount of time. Once the fixture 12 is returned to the closed orientation 26 after filling, the system 10 will then be able to dispense soap.

In another example, the LED 32 may illuminate by flashing green, red, or any other color when the power source is determined to have low power, for example, but not limited to, less than 5 volts. In the representative embodiment of the invention, the LED indications for soap levels are prioritized over the LED indication for low power. To indicate that the power source has low power, the LED 32 may cycle between on and off for any number of seconds. In a particular embodiment of the invention, the LED 32 may flash by cycling between on for 0.2 seconds and off for 2 seconds. Further, the LED 32 may use a number of colors when on. For example, the LED 32 may switch between red and green for the 0.2 seconds. That is, the LED 32 may be red for 0.1 seconds, green for 0.1 seconds, and then turn off for 2 seconds. It is further contemplated that the LED 32 may remain operational for low power indication until the power source is detected to reach a certain minimum, for example, but not limited to, 3 volts or more. At this point, the power level detection and the soap level detection may be deactivated in order to save power.

The LED 32 may also be used to indicate usage of the system 10. For instance, the LED 32 may flash green, red, or any other color while the soap dispensing element 36 discharges soap to the user's hands. In some embodiments of the system, the LED 32 may indicate usage every time that the sensor 44 detects a user's hands and the soap dispensing element 36 discharges soap. In other embodiments of the invention, the usage indication may be limited to activation of the soap dispensing element 36 during priming of the system, in which air is removed from the fluid supply line 46.

As shown in FIG. 2, the upper mount 64 of the refill port 58 may include a recess or notch 78 formed in an outer surface 80 thereof. The recess 78 is formed to receive the collar 30, so that the depth of the recess 78 is equal to the width of the collar 30. As a result, an outer surface 82 of the collar 30 is aligned with the outer surface 80 of the upper mount 64 to form a flush transition between the respective outer surfaces 80, 82. The collar 30 is sandwiched between the upper mount 64 and the upper surface 14 of the countertop 16. More specifically, an upper surface 35 of the collar 30 is in contact with the upper mount 64 of the mounting shank and a lower surface 33 of the collar 30 is in contact with the upper surface 14 of the countertop 16.

In the closed orientation 26 of FIG. 1, the main body 22 of the fixture 12 is coupled to mounting shank 24 of the fixture 12. In turn, first and second fluid connectors 48, 50 (see FIG. 3) are coupled together to allow fluid to flow from a pump, through the supply line 46, and to the dispenser 36 of the fixture 12. In the open orientation 28 of FIG. 2, the main body 22 of the fixture 12 is decoupled from the mounting shank 24 of the fixture 12. In turn, first and second fluid connectors 48, 50 are decoupled from each other to fluidically decouple the supply line 46 and the pump. As a result, the fixture 12 is unable to dispense fluid while in the open orientation 28.

In addition, the fixture 12 may include a proximity sensor (not shown) configured to detect whether the main body 22 and the mounting shank 24 are in the closed orientation 26 or the open orientation 28. The proximity sensor may be disposed within the main body 22 and electrically coupled to the sensor 44 and/or dispensing element 36. As such the proximity sensor may prevent activation of the dispensing element 36 when it detects that the main body 22 and the mounting shank 24 are in the open orientation 28.

FIG. 2 also provides a further representative embodiment of the mounting shank 24. As shown, the mounting shank 24 includes a plurality of supports 34 extending upward from a top surface 84 of the upper mount 64 of the mounting shank 24. The supports 34 may be in the form of tapered pins disposed on opposite sides of a rear end 37 of the mounting shank 24. However, it is also contemplated that the supports 34 may be in the form of other shapes. The supports 34 are also configured to prevent movement and provide structural support for the fixture 12 when in the closed orientation 26 by extending upward and into the cavity 13 of the fixture 12. While FIG. 2 illustrates the use of two (2) supports 34 disposed at the rear of the mounting shank 24, it is contemplated that varying embodiments of the invention may include more or less than two (2) supports 34 extending upward from the mounting shank 24 at a variety of locations surrounding the refill port 58. Additionally, the mounting shank 24 may include at least one additional support wall 70 extending upward from the top surface 84 of the mounting shank 24 at locations between the supports 34 and surrounding or at least partially surrounding the refill port 58. In turn, the additional support walls 70 extend into the cavity 13 of the fixture 12 and provide additional structural support.

Additionally, the support walls 70 may be used to guide the main body 22 as it is transferred between the open orientation 28 and the closed orientation 26. As shown in FIG. 3, an outer surface 71 of the support walls 70 is configured to be directly adjacent an inner surface 23 of the main body 22. As a result, the support walls 70 are able to guide movement of the main body 22 and the mounting shank 24 without providing friction between the components.

Figure 4:
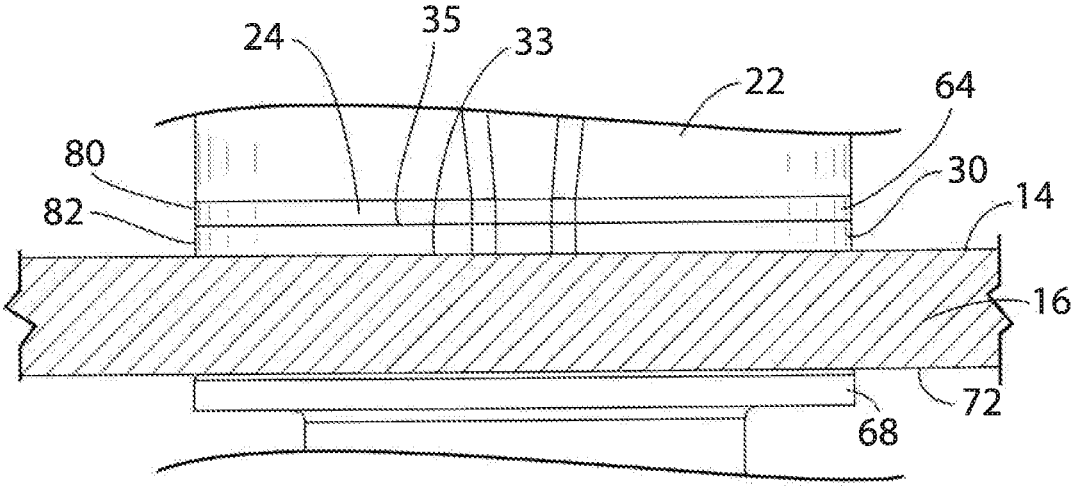
FIG. 4 is a side cross-sectional view of the dispenser system of FIG. 1.

In addition, while FIG. 2 illustrates the second fluid connector 50 and wire guide 56 as being disposed at rear locations of the mounting shank 24, it is contemplated that the second fluid connector 50 and the wire guide 56 may be located at any locations on the mounting shank 24 surrounding the refill port 58. Additionally, the second fluid connector 50 may extend upward from the top surface 84 of the mounting shank 24 a distance equal to the height of the support wall 70, as shown in FIG. 4, or a distance more or less than the height of the support wall 70. Similarly, the wire guide 56 may extend upward from the top surface 84 of the mounting shank 24 a distance greater than the height of the support wall 70, as shown in FIG. 2, or a distance equal to or less than the height of the support wall 70. For example, at least one of the second fluid connector 50 and wire guide 56 may be flush with a top surface 84 of the mounting shank 24.

Next, FIG. 4 illustrates an enlarged front view of the mounting shank 24 and, more specifically, the collar 30. As shown, the mounting shank 24 includes an upper mount 64 disposed above the countertop 16 and a lower mount 68 disposed below the countertop 16. In turn, the upper mount 64 and the lower mount 68 are each sized larger than the opening in the countertop 16 (see FIG. 3), to sandwich the countertop 16 between the upper mount 64 and the lower mount 68. Further, the collar 30 is disposed within the previously described recess 78 formed in the outer surface 80 of the upper mount 64. As such, the collar 30 is disposed between the upper mount 64 of the fixture mount 24 and the countertop 16. As previously discussed, the collar 30 is sized to fit within the recess 78 so that the outer surface 80 of the fixture mount 24 is flush with the outer surface 82 of the collar 30. In other embodiments of the invention, the collar 30 may be sized so that its outer surface 82 extends beyond or is spaced inward from the outer surface 80 of the fixture mount 24.

Figure 5:
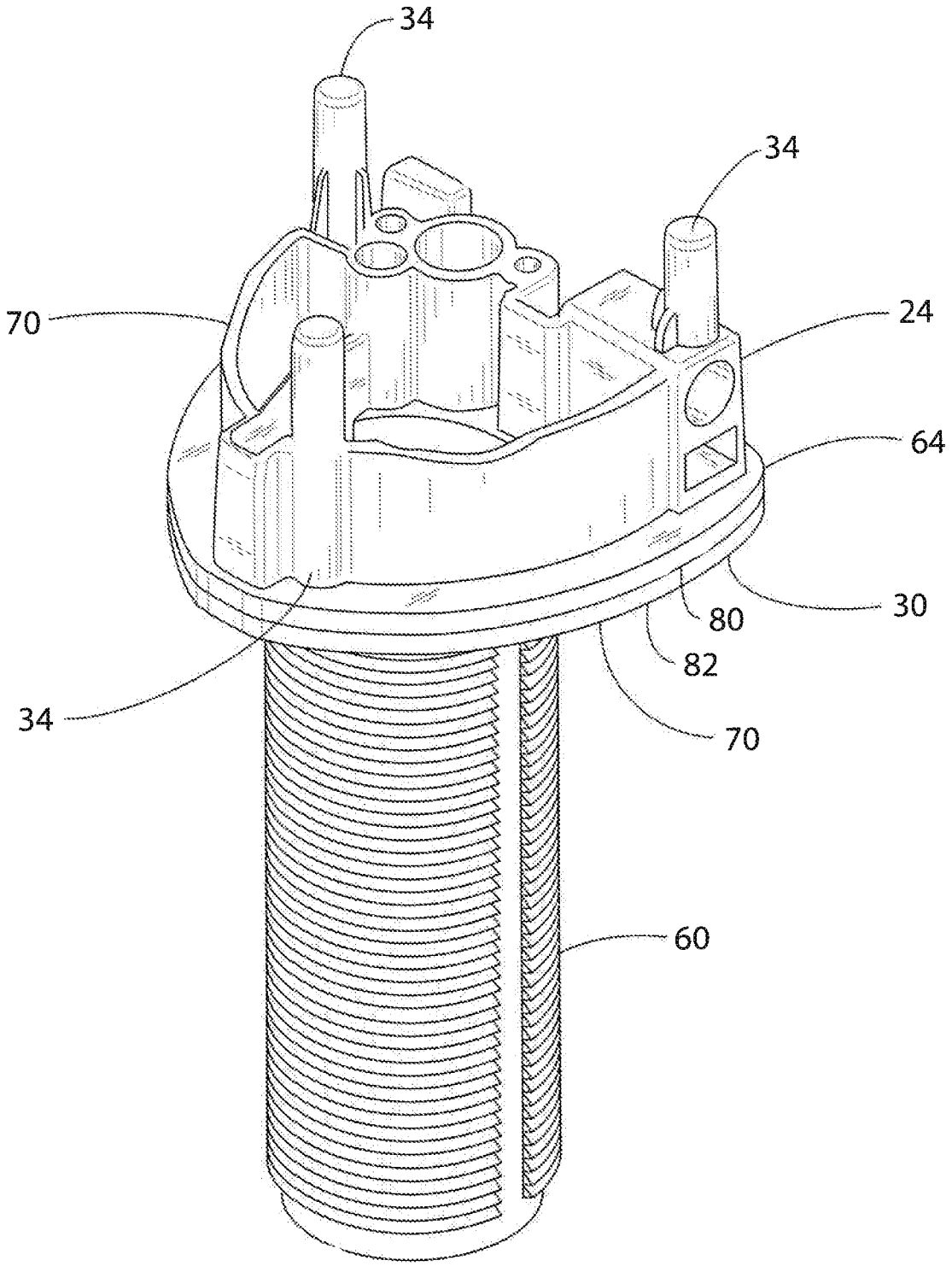
FIG. 5 is a perspective view of the mounting shank of the dispenser system of FIG. 1 with collar, according to an embodiment of the invention.

Now referring to FIG. 5, a mounting shank 24 and collar 30 are shown, according to an embodiment of the invention. As previously discussed, the collar 30 is disposed in a recess 78 of the upper mount 64 of the mounting shank 24 in order to be sandwiched between the mounting shank 24 and the countertop 16. In turn, the outer surface 82 of the collar 30 is aligned with the outer surface 80 of the upper mount 64 of the mounting shank 24.

Figure 6:
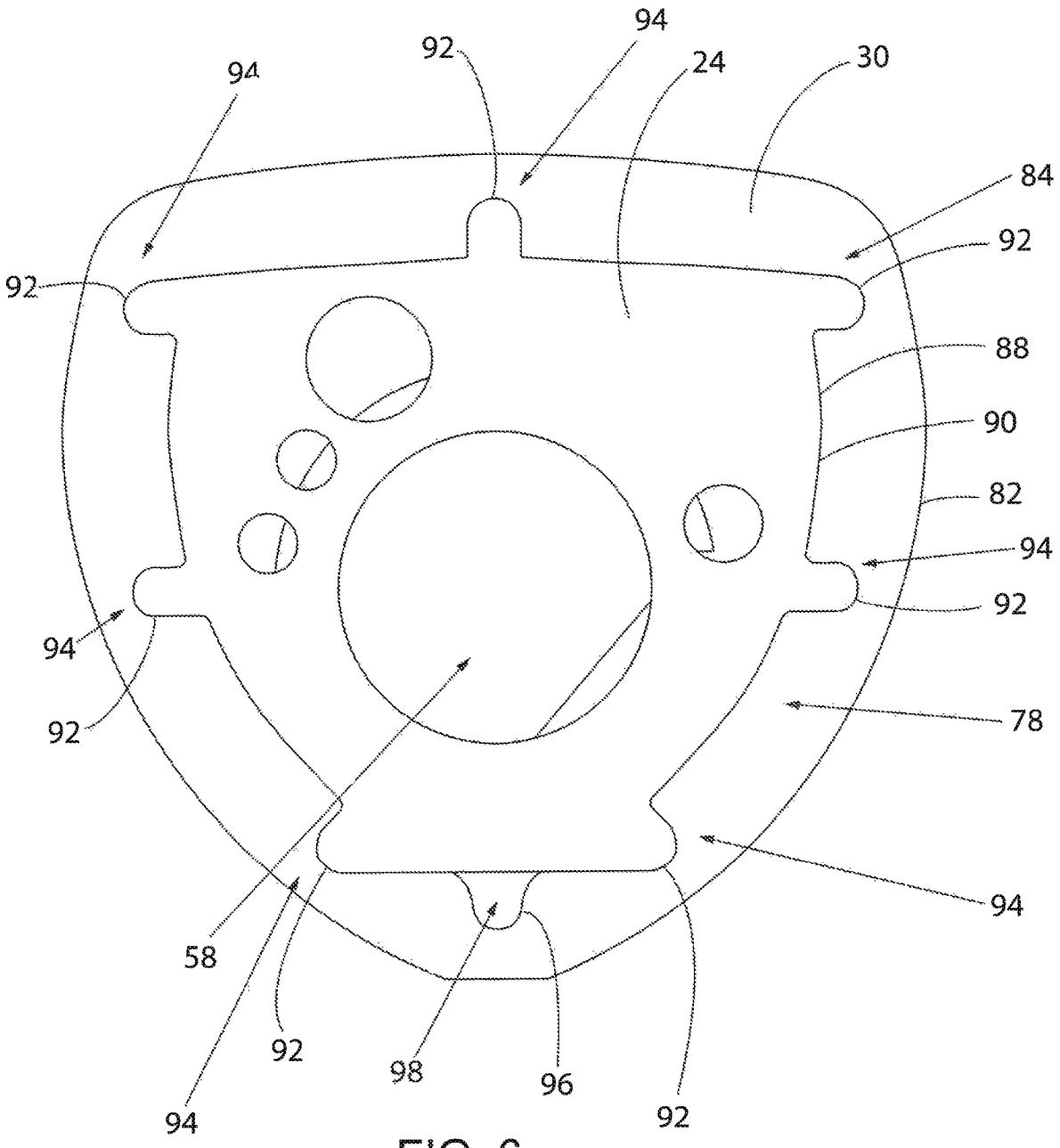
FIG. 6 is a top cross-sectional view of the dispenser system with the collar of FIG. 5.

FIG. 6 illustrates a cross-sectional view of the collar 30 to illustrate the interaction between an inner surface 88 of the collar and the mounting shank 24. A second outer surface 90 of the upper mount 64 of the mounting shank 24 is disposed inward from the outer surface 80 of the upper mount 64 of the mounting shank 24 in order to form the above discussed recess 78 in which the collar 30 is positioned. The second outer surface 90 of the mounting shank 24 is aligned vertically with the collar 30, so that the inner surface 88 of the collar 30 is in contact with the second outer surface 90 of the upper mount 64 of the mounting shank 24.

As shown in FIG. 6, the second outer surface 90 of the mounting shank 24 includes one or more contour features 92 in the form of extensions extending outward from the second outer surface 90 of the mounting shank 24. The inner surface 88 of the collar 30 includes corresponding one or more contour features 94 in the form of recesses formed therein and configured to receive the contour features 92 of the mounting shank 24. In varying embodiments of the invention, the contour features 94 of the collar 30 may alternatively extend inward as recesses formed in the inner surface 88 of the collar and the contour features 92 of the mounting shank 24 may be configured to receive the contour features 94 of the collar 30 in the form of extensions. Further yet, varying embodiments of the invention may include the contour features 92 of the mounting shank 24 in the form of both extensions and recesses to correspond with matching contour features 94 of the collar 30 in the form of recesses and extensions. By having a plurality of contour features 92, 94 interfitting with each other at various locations along collar 30 and the mounting shank 24, the collar 30 is held in position and is unable to mistakenly rotate or become misaligned. In turn, the outer surface 82 of the collar 30 and the outer surface 80 of the mounting shank 24 are kept in alignment with each other during an interaction with the system 10 and its components.

The inner surface 88 of the collar 30 further includes an indent 96 formed therein. As shown in FIG. 6, the outer surface 90 of the mounting shank 24 is spaced apart from the inner surface 88 of the collar 30 at the indent 96. In turn, an opening 98 is formed. A user is able to interact with the opening 98 to remove the collar 30 from the mounting shank 24, in instances such as the collar 30 needing to be replaced.

Figure 7:
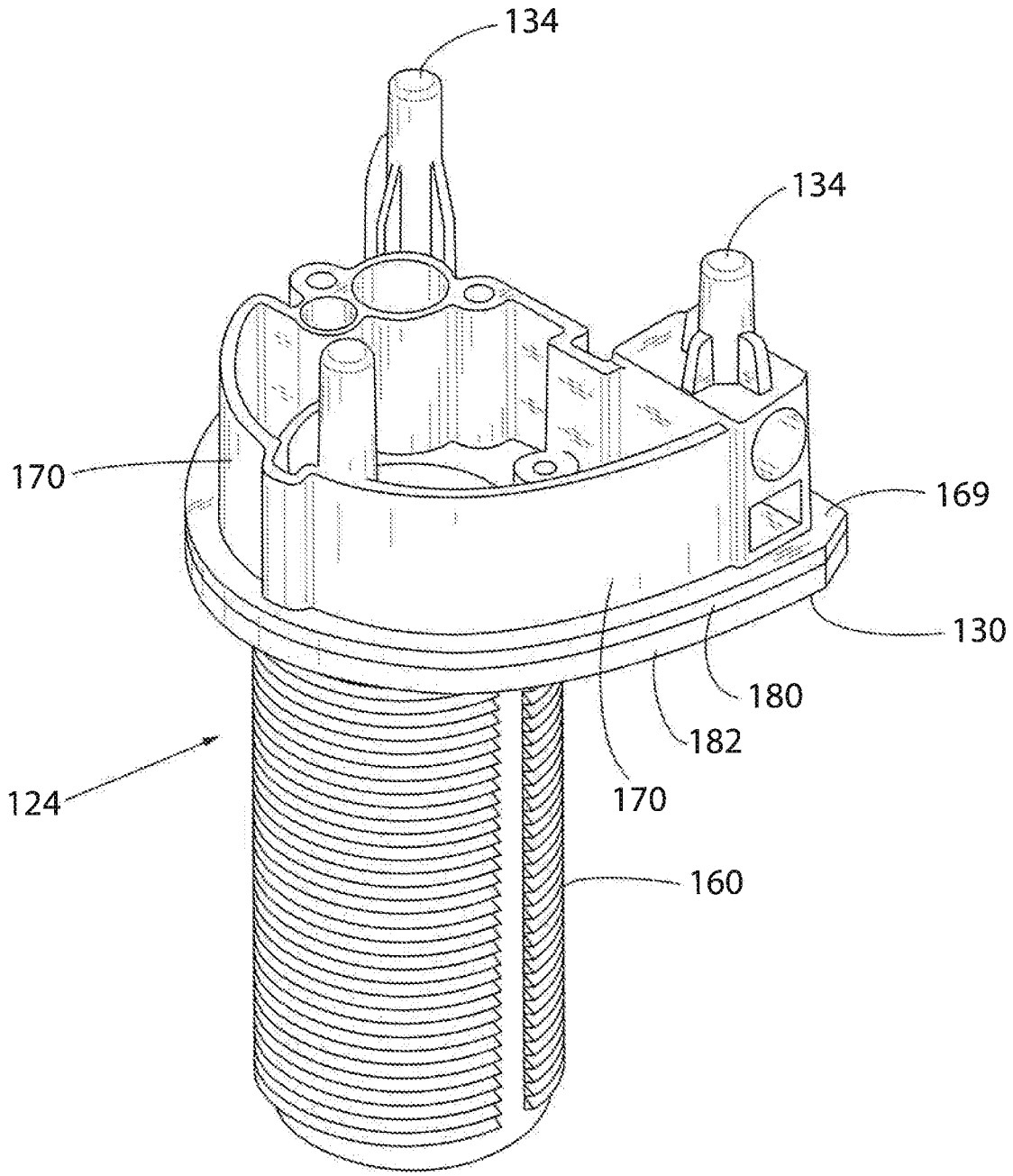
FIG. 7 is a perspective view of a mounting shank with collar, according to another embodiment of the invention.
Figure 8:
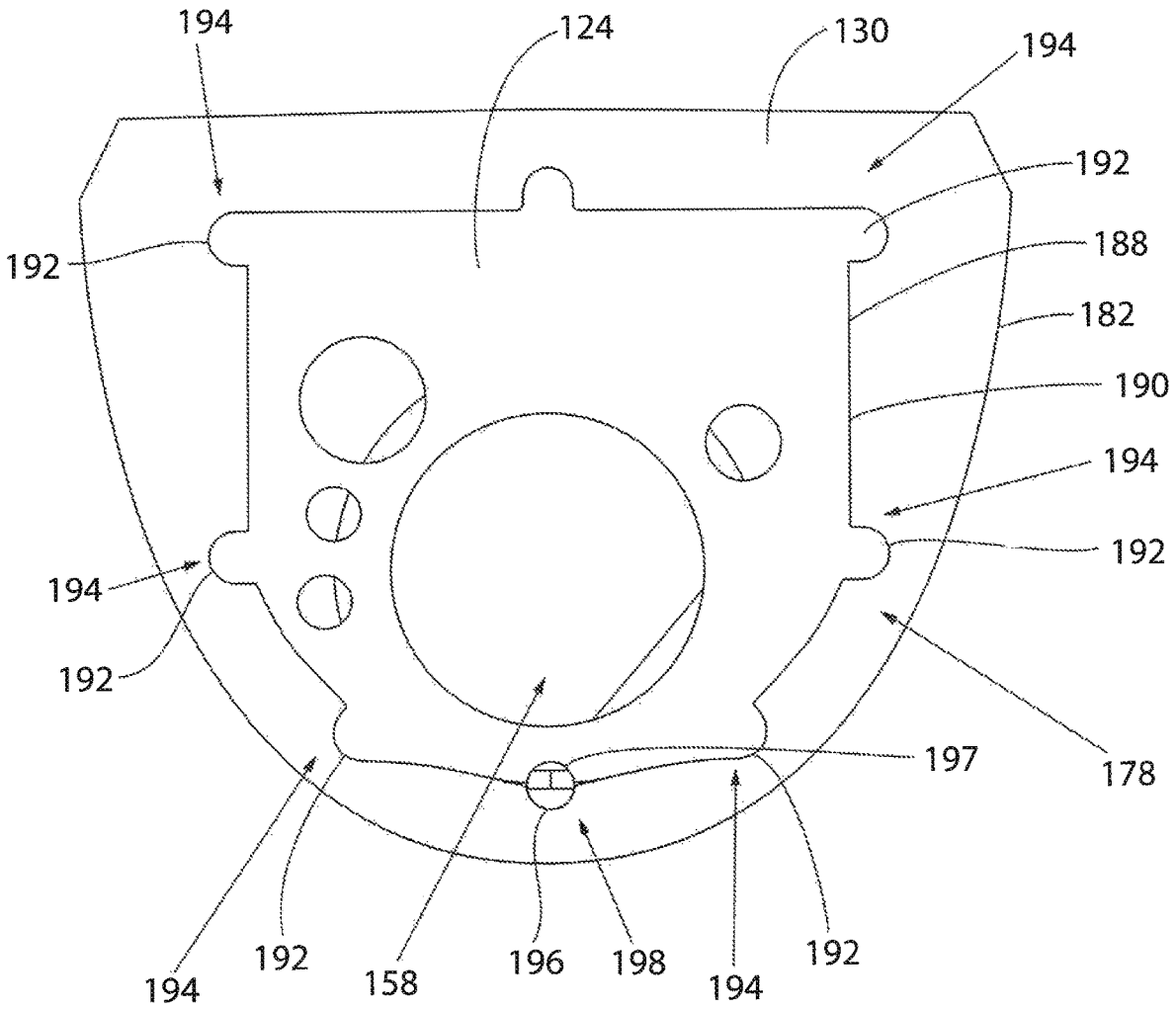
FIG. 8 is a top cross-sectional view of the dispenser system with the collar of FIG. 7.

FIGS. 7 and 8 illustrate a mounting shank 124 and a collar 130 according to another embodiment of the invention. The collar 130 is disposed in a recess 178 of the upper mount 164 of the mounting shank 124 in order to be sandwiched between the mounting shank 124 and the countertop. In turn, the outer surface 182 of the collar 130 is aligned with the outer surface 180 of the mounting shank 124. FIG. 8 illustrates a cross-sectional view of the collar 130 to illustrate the interaction between an inner surface 188 of the collar and the mounting shank 124. A second outer surface 190 of the mounting shank 124 is disposed inward from the outer surface 180 of the mounting shank 124 in order to form the above discussed recess 178 in which the collar 130 is positioned. The second outer surface 190 of the mounting shank 124 is aligned vertically with the collar 130, so that the inner surface 188 of the collar 130 is in contact with the second outer surface 190 of the mounting shank 124.

As shown in FIG. 8, the second outer surface 190 of the mounting shank 124 includes one or more contour features 192 extending outward from the second outer surface 190 of the mounting shank 124. The inner surface 188 of the collar 130 includes one or more corresponding contour features 194 formed therein and configured to receive the contour features 192 of the mounting shank 124. In varying embodiments of the invention, the contour features 194 of the collar 130 may alternatively extend inward from the inner surface 188 of the collar 130 and the contour features 192 of the mounting shank 124 may be configured to receive the contour features 194 of the collar 130. By having a plurality of contour features 192, 194 interfitting with each other at various locations along collar 130 and the mounting shank 124, the collar 130 is held in position and is unable to mistakenly rotate or become misaligned. In turn, the outer surface 182 of the collar 130 and the outer surface 180 of the mounting shank 124 are kept in alignment with each other during an interaction with the system 10 and its components.

The inner surface 188 of the collar 130 further includes an indent 196 formed therein. As shown in FIG. 8, the outer surface 190 of the mounting shank 124 is spaced apart from the inner surface 188 of the collar 130 at the indent 196 via its own indent 197 aligned therewith. In turn, an opening 198 is formed. A user is able to interact with the opening 198 to remove the collar 130 from the mounting shank 124, in instances such as the collar 130 needing to be replaced.

Figure 9:
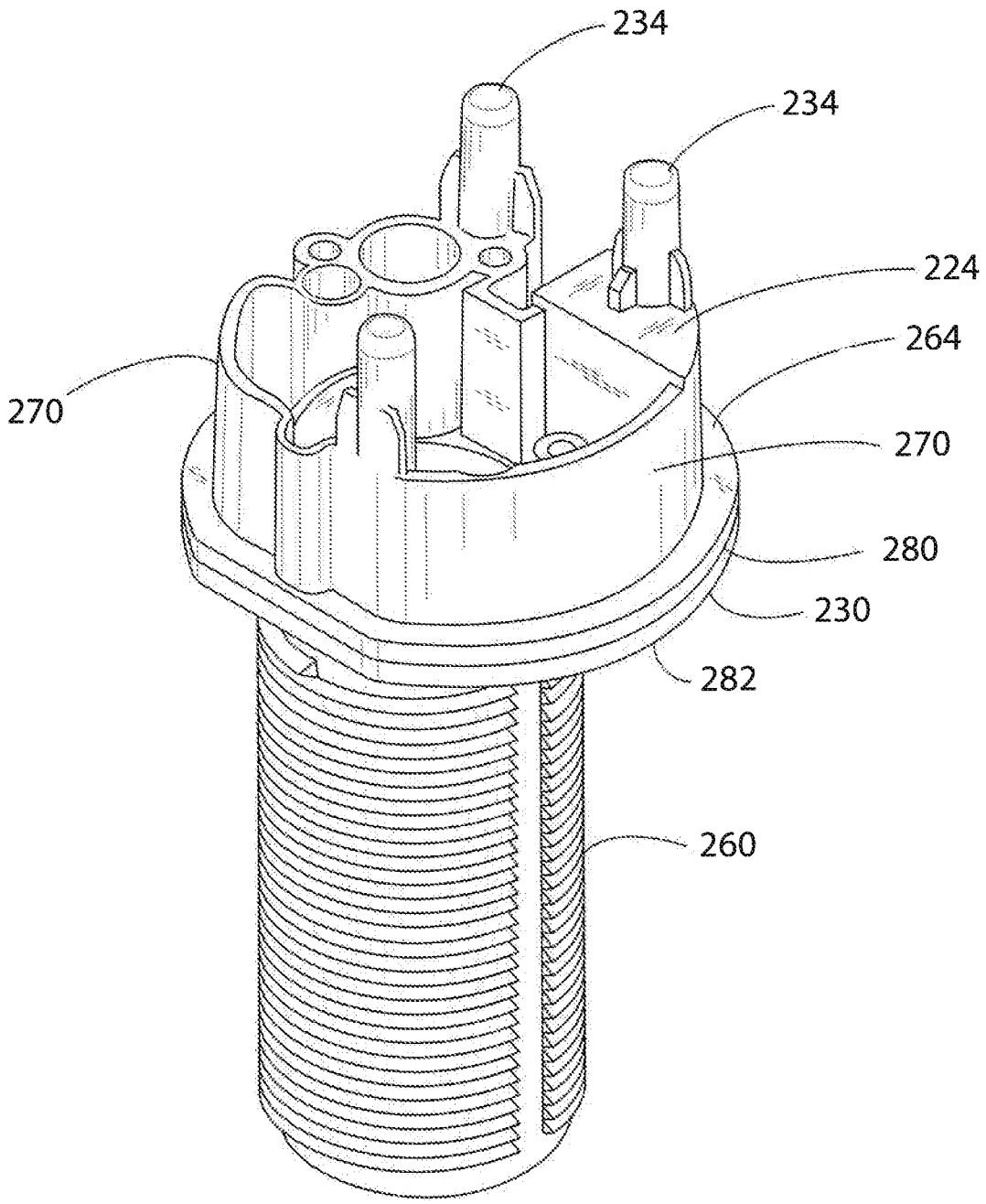
FIG. 9 is a perspective view of a mounting shank with collar, according to yet another embodiment of the invention.
Figure 10:
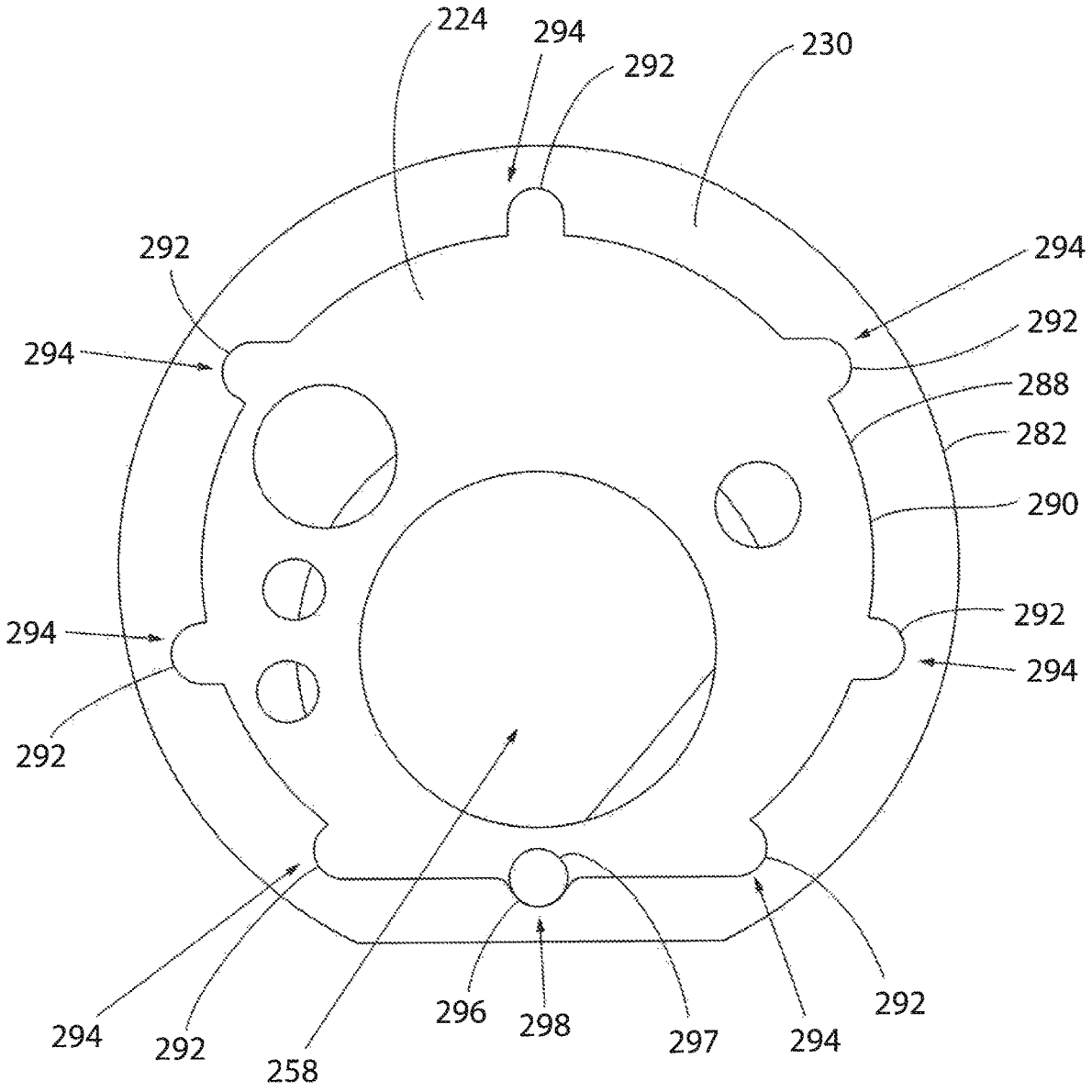
FIG. 10 is a top cross-sectional view of the dispenser system with the collar of FIG. 9.

Next, FIGS. 9 and 10 illustrate amounting shank 224 and collar 230 according to another embodiment of the invention. The collar 230 is disposed in a recess 278 of the upper mount 264 of the mounting shank 224 in order to be sandwiched between the mounting shank 224 and the countertop. In turn, the outer surface 282 of the collar 230 is aligned with the outer surface 280 of the mounting shank 224. FIG. 10 illustrates a cross-sectional view of the collar 230 to illustrate the interaction between an inner surface 288 of the collar and the mounting shank 224. A second outer surface 290 of the mounting shank 224 is disposed inward from the outer surface 280 of the mounting shank 224 in order to form the above discussed recess 278 in which the collar 230 is positioned. The second outer surface 290 of the mounting shank 224 is aligned vertically with the collar 230, so that the inner surface 288 of the collar 230 is in contact with the second outer surface 290 of the mounting shank 224.

As shown in FIG. 10, the second outer surface 290 of the mounting shank 224 includes one or more contour features 292 extending outward from the second outer surface 290 of the mounting shank 224. The inner surface 288 of the collar 230 includes one or more corresponding contour features 294 formed therein and configured to receive the contour features 292 of the mounting shank 224. In varying embodiments of the invention, the contour features 294 of the collar 230 may alternatively extend inward from the inner surface 288 of the collar 230 and the contour features 292 of the mounting shank 224 may be configured to receive the contour features 294 of the collar 230. By having a plurality of contour features 292, 294 interfitting with each other at various locations along collar 230 and the mounting shank 224, the collar 230 is held in position and is unable to mistakenly rotate or become misaligned. In turn, the outer surface 282 of the collar 230 and the outer surface 280 of the mounting shank 224 are kept in alignment with each other during an interaction with the system 10 and its components.

The inner surface 288 of the collar 230 further includes an indent 296 formed therein. As shown in FIG. 10, the outer surface 290 of the mounting shank 224 is spaced apart from the inner surface 288 of the collar 230 at the indent 296 via its own indent 297 aligned therewith. In turn, an opening 298 is formed. A user is able to interact with the opening 298 to remove the collar 230 from the mounting shank 224, in instances such as the collar 230 needing to be replaced.

Figure 11:
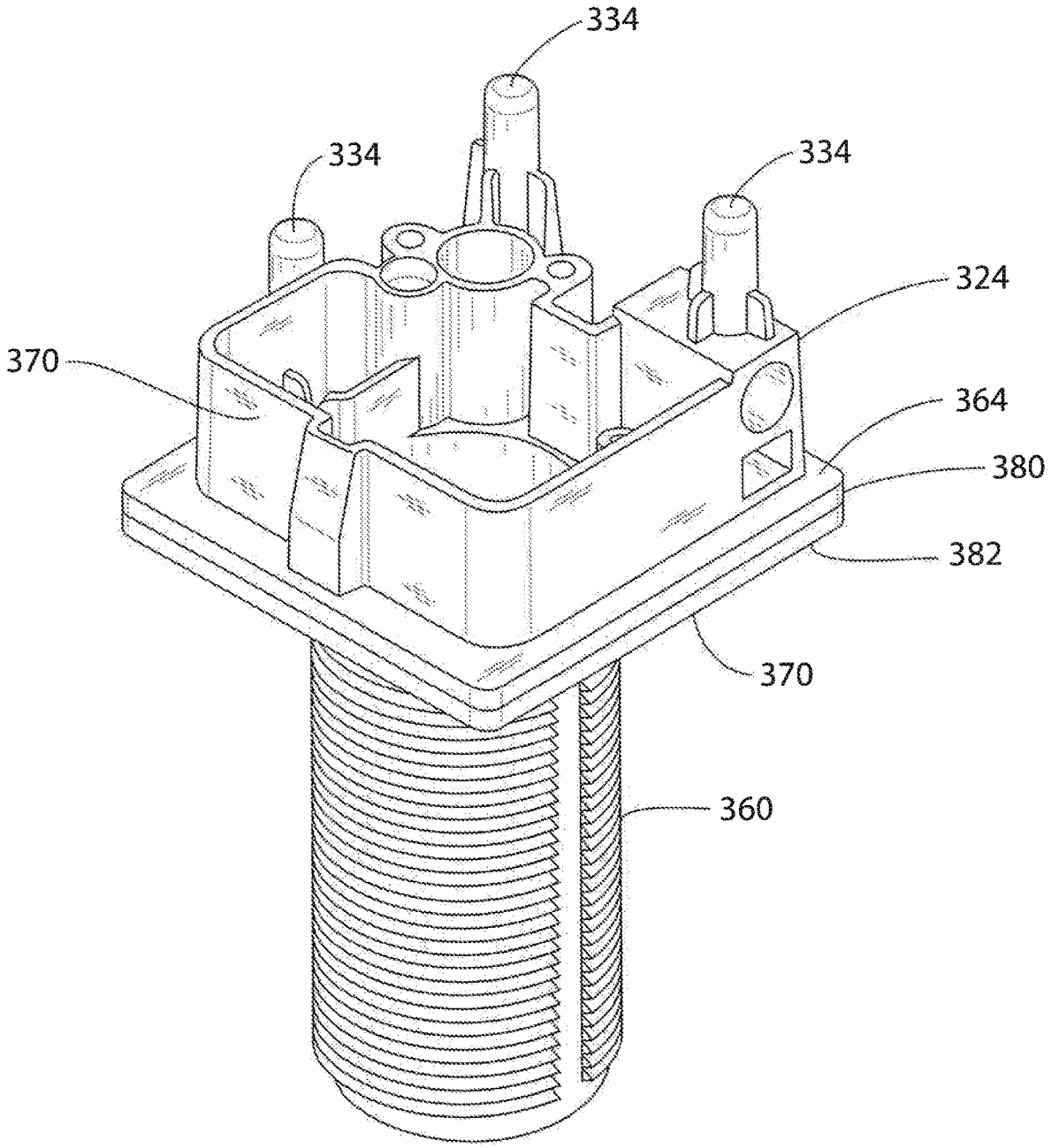
FIG. 11 is a perspective view of a mounting shank with collar, according to another embodiment of the invention.
Figure 12:
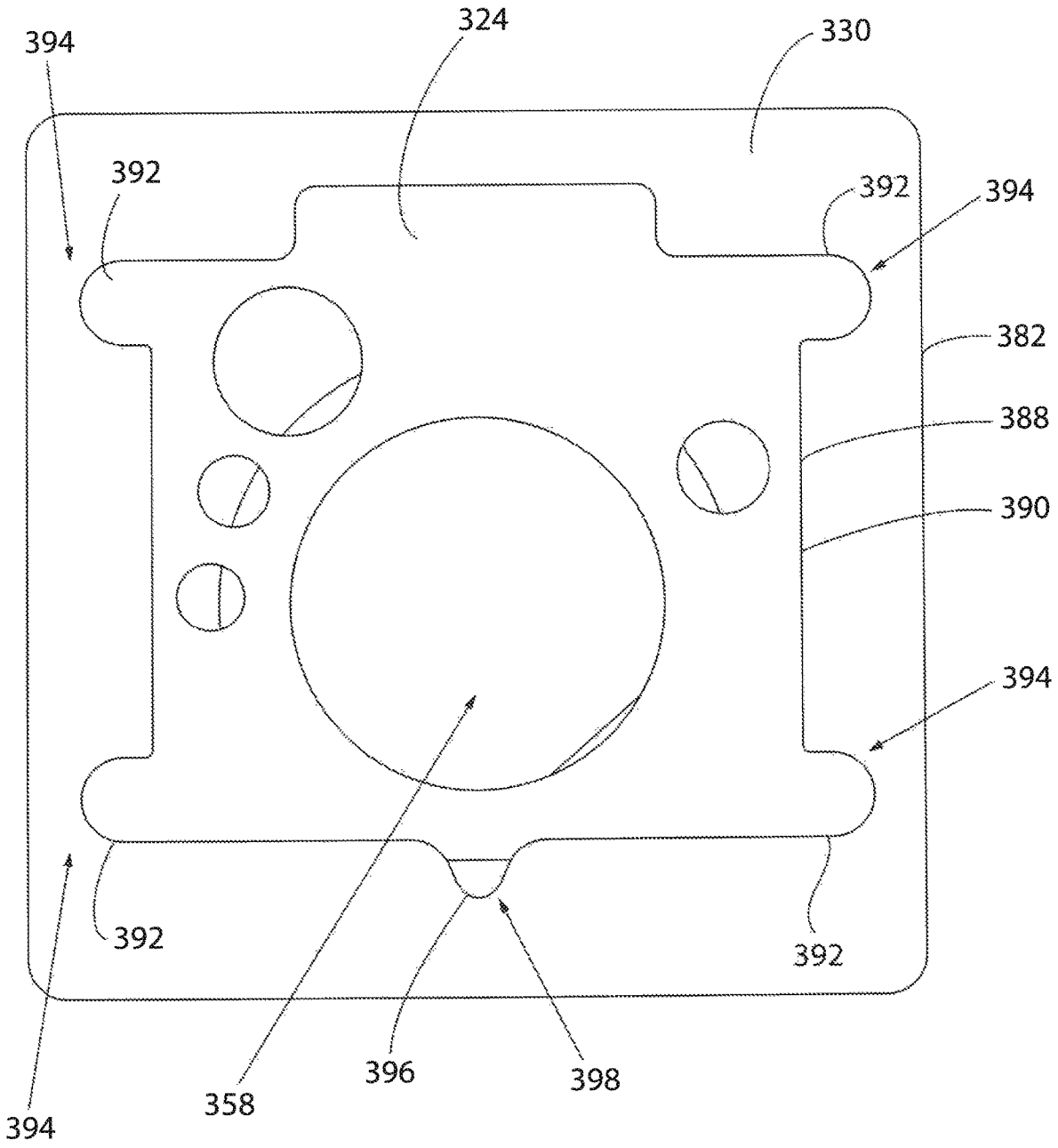
FIG. 12 is a top cross-sectional view of the dispenser system with the collar of FIG. 11.

Next, FIGS. 11 and 12 illustrate a mounting shank 324 and collar 330 according to another embodiment of the invention. The collar 330 is disposed in a recess 378 of the upper mount 364 of the mounting shank 324 in order to be sandwiched between the mounting shank 324 and the countertop. In turn, the outer surface 382 of the collar 330 is aligned with the outer surface 380 of the mounting shank 324. FIG. 12 illustrates a cross-sectional view of the collar 330 to illustrate the interaction between an inner surface 388 of the collar and the mounting shank 324. A second outer surface 390 of the mounting shank 324 is disposed inward from the outer surface 380 of the mounting shank 324 in order to form the above discussed recess 378 in which the collar 330 is positioned. The second outer surface 390 of the mounting shank 324 is aligned vertically with the collar 330, so that the inner surface 388 of the collar 330 is in contact with the second outer surface 390 of the mounting shank 324.

As shown in FIG. 12, the second outer surface 390 of the mounting shank 324 includes one or more contour features 392 extending outward from the second outer surface 390 of the mounting shank 324. The inner surface 388 of the collar 330 includes one or more corresponding contour features 394 formed therein and configured to receive the contour features 392 of the mounting shank 324. In varying embodiments of the invention, the contour features 394 of the collar 330 may alternatively extend inward from the inner surface 388 of the collar 330 and the contour features 392 of the mounting shank 324 may be configured to receive the contour features 394 of the collar 330. By having a plurality of contour features 392, 394 interfitting with each other at various locations along collar 330 and the mounting shank 324, the collar 330 is held in position and is unable to mistakenly rotate or become misaligned. In turn, the outer surface 382 of the collar 330 and the outer surface 380 of the mounting shank 324 are kept in alignment with each other during an interaction with the system 10 and its components.

The inner surface 388 of the collar 330 further includes an indent 396 formed therein. As shown in FIG. 12, the outer surface 390 of the mounting shank 324 is spaced apart from the inner surface 388 of the collar 330 at the indent 396. In turn, an opening 398 is formed. A user is able to interact with the opening 398 to remove the collar 330 from the mounting shank 324, in instances such as the collar 330 needing to be replaced.

As shown in FIGS. 6, 8, 10, and 12, the contours 92, 94, 192, 194, 292, 294, 392, 394 are formed in the surfaces of the mounting shank 24, 124, 224, 324 and collar 30, 130, 230, 330 at various locations around the entire surfaces. It is contemplated that in various embodiments of the inventions, the contours 92, 94, 192, 194, 292, 294, 392, 394 may be disposed on a single side (i.e., front side, rear side, left side, right side) of the mounting shank 24, 124, 224, 324 and collar 30, 130, 230, 330. It is further contemplated that the contours 92, 94, 192, 194, 292, 294, 392, 394 may be disposed on opposite sides of the mounting shank 24, 124, 224, 324 and collar 30, 130, 230, 330. Further yet, it is contemplated that the contours 92, 94, 192, 194, 292, 294, 392, 394 may be disposed on any number of and any combination of sides of the mounting shank 24, 124, 224, 324 and collar 30, 130, 230, 330.

While FIGS. 6, 8, 10, and 12 illustrate the opening 98, 198, 298, 398 and related indents 96, 196, 197, 296, 297, 396 as being disposed adjacent the front of the mounting shank 24, 124, 224, 324 and collar 30, 130, 230, 330, it is contemplated that they may be located adjacent any side of the mounting shank 24, 124, 224, 324 and collar 30, 130, 230, 330.

Although the best mode contemplated by the inventors of carrying out the present invention is disclosed above, practice of the present invention is not limited thereto. It will be manifest that various additions, modifications and rearrangements of the features of the present invention may be made without deviating from the spirit and scope of the underlying inventive concept.

Moreover, the individual components need not be formed in the disclosed shapes, or assembled in the disclosed configuration, but could be provided in virtually any shape, and assembled in virtually any configuration. Furthermore, all the disclosed features of each disclosed embodiment can be combined with, or substituted for, the disclosed features of every other disclosed embodiment except where such features are mutually exclusive.

Further, the individual components discussed above are not limited to any material. That is, each component may independently be made from any material such as, but not limited to, metal, plastic, wood, etc.

It is intended that the appended claims cover all such additions, modifications and rearrangements. Expedient embodiments of the present invention are differentiated by the appended claims.

What is claimed is:

1. A soap dispenser system comprising:

a soap dispenser mounted to a mounting shank, the mounting shank disposed above a countertop and extending below the countertop through an opening in the countertop;

an opening disposed within the mounting shank and extending from above the countertop to below the countertop; and a mounting collar disposed between the countertop and the mounting shank at a location outside the opening of the mounting shank, the mounting collar including:

an outer surface of the mounting collar aligned with a first outer surface of the mounting shank directly above the outer surface of the mounting collar; and an inner surface of the mounting collar in contact with a second outer surface of the mounting shank disposed at a same vertical location as the mounting collar, the inner surface having a plurality of contour features configured to interfit with a plurality of contour features of the mounting shank in order to maintain alignment of the mounting collar and the mounting shank.

2. The soap dispenser system of claim 1 wherein the inner surface of the mounting collar includes an indent formed therein, the indent configured to space apart the inner surface of the mounting collar from the second outer surface of the mounting shank to form an opening.

3. The soap dispenser system of claim 2 wherein the second outer surface of the mounting shank includes an indent aligned with the indent of the inner surface of the mounting collar.

4. The soap dispenser system of claim 2 wherein the opening is disposed adjacent a front portion of the mounting collar and the mounting shank.

5. The soap dispenser system of claim 1 wherein the plurality of contour features of the mounting collar are disposed on a single side of the mounting collar; and wherein the plurality of contour features of the mounting shank are disposed on a single side of the mounting shank.

6. The soap dispenser system of claim 5 wherein the plurality of contour features of the mounting collar are at least one of an extension or recess formed on the inner surface of the mounting collar;

wherein the plurality of contour features of the mounting shank are at least one of a recess or extension formed on the inner surface of the mounting shank.

7. The soap dispenser system of claim 1 wherein the plurality of contour features of the mounting collar are disposed on a plurality of sides of the mounting collar; and wherein the plurality of contour features of the mounting shank are disposed on a plurality of sides of the mounting shank.

8. The soap dispenser system of claim 7 wherein the plurality of contour features of the mounting collar are disposed on opposite sides of the mounting collar; and wherein the plurality of contour features of the mounting shank are disposed on opposite sides of the mounting shank.

9. The soap dispenser system of claim 7 wherein the plurality of contour features of the mounting collar are at least one of an extension or recess formed on the inner surface of the mounting collar;

wherein the plurality of contour features of the mounting shank are at least one of an extension or recess formed on the inner surface of the mounting shank.

10. A soap dispenser mounting collar comprising:

a lower surface in contact with a countertop;

an upper surface in contact with a soap dispenser mounting shank, the soap dispenser mounting shank extending through the soap dispenser mounting collar;

an outer surface of the soap dispensing mounting collar aligned with a first outer surface of the soap dispenser mounting shank directly above the outer surface of the soap dispenser mounting collar; and an inner surface of the soap dispensing mounting collar in contact with a second outer surface of the soap dispenser mounting shank extending through the soap dispenser mounting collar, the inner surface having a plurality of contour features configured to interfit with a plurality of contour features of the soap dispenser mounting shank in order to maintain alignment of the soap dispenser mounting collar and the soap dispenser mounting shank.

11. The soap dispenser mounting collar of claim 10 wherein the inner surface of the soap dispenser mounting collar includes an indent formed therein, the indent configured to space apart the inner surface of the soap dispenser mounting collar from the second outer surface of the soap dispenser mounting shank and form an opening therebetween.

12. The soap dispenser mounting collar of claim 11 wherein the opening is disposed adjacent a front portion of the soap dispenser mounting collar.

13. The soap dispenser mounting collar of claim 10 wherein the plurality of contour features of the soap dispenser mounting shank are disposed on one or more sides of the soap dispenser mounting shank.

14. The soap dispenser mounting collar of claim 13 wherein the plurality of contour features of the mounting collar are disposed on opposite sides of the mounting collar.

15. The soap dispenser mounting collar of claim 10 wherein the plurality of contour features of the mounting collar are at least one of an extension or recess formed on the inner surface of the mounting collar; and wherein the plurality of contour features of the mounting shank are at least one of a recess or extension formed on the inner surface of the mounting shank and corresponding to the at least one of an extension or recess of the plurality of contour features of the mounting collar.

16. A soap dispenser system comprising:

a soap dispenser mounted to a mounting shank, the mounting shank including:

an upper mount disposed above a countertop, the upper mount including a recess formed in the outer surface thereof adjacent the countertop; and a refill port extending below the countertop through an opening in the countertop;

a mounting collar disposed between the countertop and the upper mount and within the recess, the mounting collar including:

an outer surface of the mounting collar aligned with a first outer surface of the upper mount directly above the recess; and an inner surface of the mounting collar in contact with a second outer surface of the upper mount aligned with the recess;

a plurality of contour features formed on the inner surface of the mounting collar, the plurality of contour features configured to interfit with a plurality of contour features of the upper mount in order to maintain alignment of the mounting collar and the upper mount.

17. The soap dispenser system of claim 16 wherein the mounting shank further includes a lower mount disposed below the countertop and surrounding a lower portion of the refill port.

18. The soap dispenser system of claim 16 wherein the inner surface of the mounting collar includes an indent formed therein, the indent configured to space apart the inner surface of the mounting collar from the second outer surface of the mounting shank to form an opening.

19. The soap dispenser system of claim 18 wherein the second outer surface of the mounting shank includes an indent aligned with the indent of the inner surface of the mounting collar.

20. The soap dispenser system of claim 16 wherein the plurality of contour features of the mounting collar are disposed on opposite sides of the mounting collar; and wherein the plurality of contour features of the mounting shank are disposed on opposite sides of the mounting shank.

* * * * *